United States Patent [19]

Semmens

[11] Patent Number: 5,034,164

[45] Date of Patent: Jul. 23, 1991

[54] BUBBLELESS GAS TRANSFER DEVICE AND PROCESS

[76] Inventor: Michael J. Semmens, 5029 First Ave. South, Minneapolis, Minn. 55419

[21] Appl. No.: 539,729

[22] Filed: Jun. 18, 1990

Related U.S. Application Data

[63] Continuation-in-part of Ser. No. 416,372, Oct. 2, 1989, abandoned.

[51] Int. Cl.[5] ..... B01F 3/04

[52] U.S. Cl. ..... 261/122; 210/640; 210/321.8

[58] Field of Search ..... 261/122; 210/640, 321.79, 210/321.8

[56] References Cited

U.S. PATENT DOCUMENTS

| | | | |
|---|---|---|---|
| 4,181,604 | 1/1980 | Onishi | 210/8 |
| 4,440,641 | 4/1984 | Ostertag | 210/321.79 |
| 4,755,299 | 7/1988 | Bruschke | 210/640 |
| 4,781,889 | 11/1988 | Fukasawa et al. | 261/122 |
| 4,824,444 | 4/1989 | Nomura | 55/158 |
| 4,859,331 | 8/1989 | Sachtler et al. | 210/321.8 |
| 4,886,601 | 12/1989 | Iwatsůka et al. | 210/321.79 |

OTHER PUBLICATIONS

Côté, Pierre; Bersillon, Jean-Luc; Huyard, Alain; "Bubble-Free Aeration Using Membranes: Mass Transfer Analysis", *Journal of Membrane Science,* submitted May 16, (1988).

Wilderer, P. A.; Bräutigam, J.; Sekoulov, I.; "Application of Gas Permeable Membrane for Auxiliary Oxygenation of Sequencing Batch Reactors", *Conservation & Recycling,* vol. 8, Nos. 1/2, pp. 181-192, (1985).

Côté, Pierre; Bersillon, Jean-Luc; Huyard, Alain; Faup, Gérard; "Bubble-Free Aeration Using Membranes: Process Analysis", *Journal WPCF,* 60 (11), pp. 1986-1999 (1988).

*Primary Examiner*—Tim Miles

*Attorney, Agent, or Firm*—Kinney & Lange

[57] ABSTRACT

A gas transfer device is used to transfer gas directly into a liquid without the formation of bubbles through a plurality of elongated tubular fibers having membrane walls. A portion of each fiber consists of a thin, smooth, hydrophobic, non-porous, gas permeable polymer which prevents bubble formation and inhibits the accumulation of debris and microorganisms on the outside surface of the membrane walls. The fibers have an open end connected to a regulated gas supply and a sealed end to obtain 100% gas transfer efficiency. A second portion of each fiber is wetted to result in transfer of condensate from the interior of the fibers to the exterior to provide for a continuous operation of the gas transfer device.

24 Claims, 1 Drawing Sheet

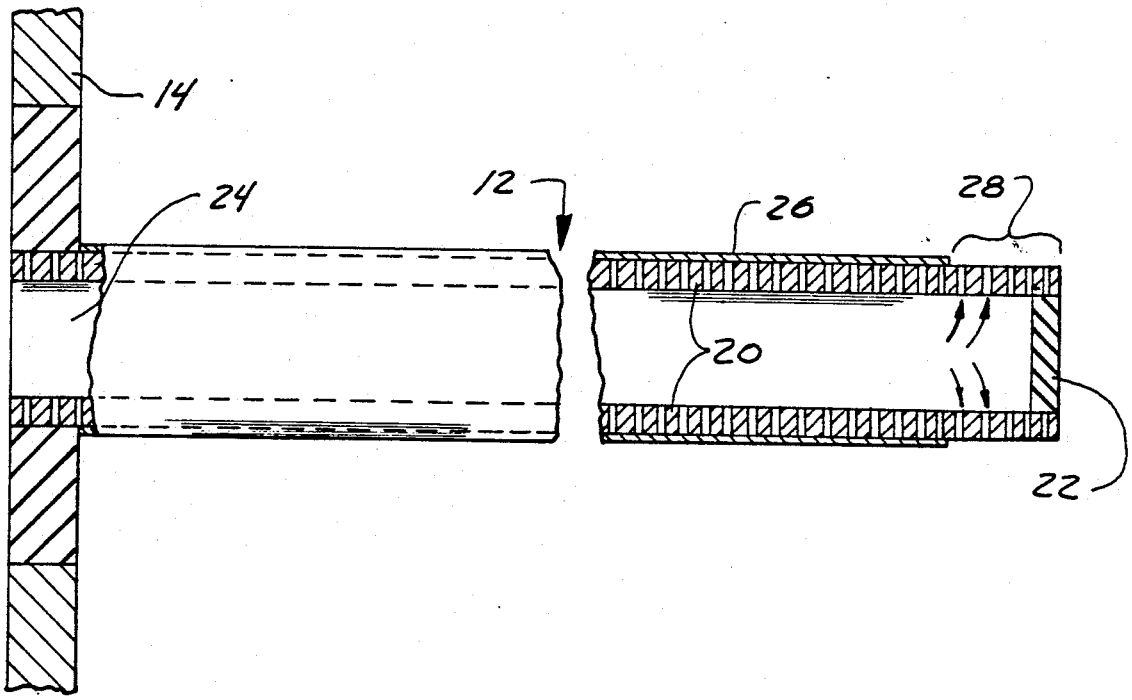

BUBBLELESS GAS TRANSFER DEVICE AND PROCESS

CROSS REFERENCE TO RELATED APPLICATION

This application is a continuation-in-part of my copending application Ser. No. 07/416,372, filed Oct. 2, 1989, now adandoned.

BACKGROUND OF THE INVENTION

1. Field of the Invention

The present invention relates to transferring gas directly into a liquid. In particular, it relates to a device which efficiently transfers gas into a liquid through a plurality of elongated tubular gas permeable membrane fibers without the formation of bubbles.

2. Description of the Prior Art

Gas transfer devices have a variety of applications, such as aeration for wastewater treatment and for improving water quality of lakes and reservoirs. It is desirable to minimize operating costs by having the most efficient transfer possible.

Pursuing the example of aeration, the major operating costs include the power required to pump air into the gas exchange devices and also the power required to pump liquid past the exterior of the gas exchange device. Although the prior art discloses a number of ways which attempt to make the transfer rate of gas more efficient through the use of different gas permeable membranes, operating difficulties have arisen. Hollow fibers having gas porous membrane walls and with the end remote from the gas source sealed have been used experimentally and have shown relatively high efficiencies but problems heretofore limited continuous operation. The use of sealed end fibers as gas transfer devices therefore has not developed despite the desired effect of efficient, bubbleless gas transfer from such fibers.

Wilderer et al. in an article entitled "Application of Gas Permeable Membranes for Auxiliary Oxygenation of Sequencing Batch Reactors," *Conservation & Recycling*, Vol. 8, Nos. 1/2, pp. 181-192 (1985) disclosed how they evaluated the effectiveness of a continuous flow of oxygen through the inside of silicon tubing for the oxygenation of waste water. They found that the transfer rate increases as the pressure of oxygen increases and the membrane thickness decreases. They also concluded that, in a wastewater aeration application, the transfer rate increases when a high concentration of oxygen is used. In addition, this high oxygen concentration is toxic to microorganisms, thus preventing them from colonizing on the membrane surface and reducing the oxygen transfer rate through the tubing wall.

In the investigations in the prior art, there has been a distinction made between a continuous flow system, that is, where oxygen will continuously flow through a hollow tube and out the remote end, as compared to a dead end or sealed end system, as shown herein. The dead end system is one where a tubular fiber having a gas permeable membrane wall is used and which fiber has the end remote from the gas inlet sealed. When pure oxygen is introduced into the fibers, and the fibers are in water, there is a back diffusion of gases such as nitrogen, water vapor, and carbon dioxide from the water to the fiber interior. As the oxygen passes outward through the walls of the membrane fiber, the concentration of water vapor, carbon dioxide and nitrogen inside the fiber increases. The greatest concentration of these species will exist at the end of the fiber that is remote from the gas inlet. Nitrogen and $CO_2$ can and will diffuse back out through the fiber wall, when the internal pressure of these gases exceeds their external partial pressure. A steady state condition between the interior and exterior of the fibers will be reached in which there is no net accumulation of these gases within the fibers. However, as the concentration of water vapor increases inside the fiber, condensation occurs before the water vapor exits the fiber. This occurs when the internal pressure of water vapor exceeds the saturation vapor pressure. This phenomenon of condensation inside dead ended fibers has been observed in experiments by earlier investigators, but the solution to the problem previously involved either flushing out the gases that back diffuse and the water vapor, or stopping and emptying the membrane at periodic intervals. Continuous operation was not possible.

One prior investigation involved maintaining oxygen at a constant pressure inside a membrane bag, while water was pumped past the outside of the membrane. Since the oxygen did not continuously flow through the membrane bag, conditions for oxygen transfer to a liquid using a closed end fiber were approximated. Analysis of the gas inside the membrane after two weeks of use revealed that 60% of the gas was nitrogen and the investigators noted that the membrane bag should be emptied and refilled frequently to "maintain an oxygen partial pressure suitable for optimum transfer" and to sweep away the nitrogen that was transferred in. This investigation essentially taught that flow through the membrane was needed for efficient oxygen transfer.

Cote et al., in an article entitled "Bubble-Free Aeration using membranes: Mass Transfer Analysis", submitted for publication in the Journal of Membrane Science (1988) which acknowledged a prior art evaluated the continuous flow of oxygen through silicon rubber tubes to oxygenate waste water. Silicon tubes were used because they are non-porous and they may be operated at a high pressure before bubbles will form. By comparison the maximum operating pressure for no bubble formation in microporous polypropylene is very low. These authors also concluded that the only way a high oxygen pressure could be used with microporous fibers, without forming bubbles, (which decrease gas transfer efficiency), was if the water surrounding the tubes was also pressurized. They explicitly state that operation using closed end tubes without flow through is to be avoided because closed ends significantly decreased the oxygen transfer performance of the membrane and led to condensation of water vapor inside the tubes. The condensation was attributed to temperature changes. They did not recognize the back diffusion of water vapor and resultant phase change as the cause.

U.S. Pat. No. 4,181,604, issued to Onishi et al. (1980), discloses a hollow fiber membrane system for supporting a culture of and supplying oxygen to microorganisms that degrade organics in wastewater. Although Onishi notes that one end of each hollow fiber may be connected to a gas supply and the other end may be sealed and allowed to float free in the liquid, the emphasis of this disclosure is on creating an attractive environment for the microorganisms and providing a large surface area of the membrane to support the microorganisms. Onishi does not address the condensation problem associated with closed end fibers.

The prior art proposes a number of ways to maximize the gas transfer rate efficiency, such as using thin-walled membranes, high gas pressures, continuous gas flow, and pure oxygen. However, a practicable method of reducing cost by efficiently transferring a gas into a liquid has not been taught. One such method is to obtain a high transfer or utilization efficiency, i.e. to transfer most or all of the gas supplied to the fibers into the liquid. This high efficiency can be obtained by using dead end fibers and providing bubbleless gas transfer so that gas supplied to the fibers is not lost or wasted. However, until the present invention such fibers would periodically fill with water and become useless until emptied.

The present invention insures that condensation in hollow fibers will be discharged on a continuing basis so continuous operation is possible.

SUMMARY OF THE INVENTION

The present invention relates to a hollow fiber membrane for efficiently transferring gas into a liquid. Each of the fibers has a gas permeable wall, an open end connected to a regulated gas supply, and an opposite sealed end. The wall material employed in a first portion of each fiber may be microporous, or microporous and coated on the exterior surface with a thin, smooth, non-porous, gas permeable polymer layer, or the wall may be a homogeneous gas permeable membrane. A second portion of each hollow fiber wall permits the passage of water under the pressure differences applied to the fiber in use. Either a microporous fiber or a homogeneous gas permeable fiber can be used for the second portion of the fiber. This portion of the fiber must be wetted, that is, the wall material is conditioned to conduct condensed water out of the tubular fiber. The wetted portion is preferably near the closed end. The wetted portion allows condensed vapor inside the fiber to pass through the fiber wall at pressures below the bubble point pressure of the wetted wall.

When using microporous fibers, the second uncoated-wetted portion of the fiber is initially wetted by use of a wetting agent. A water miscible solvent such as alcohol, or a surfactant, is used to initially fill the micro pores in the wall portion. As water vapor condenses in use the condensate inside the fiber is pushed to the sealed end of the fiber by the gas flow and there it contacts the section of the membrane that is wetted. The condensate passes into and through the micro pores of the wetted membrane wall. Capillary action keeps the pores wetted and allows a continued passage of condensate from the interior of the fibers through the pores so it is not trapped in the fibers and continuous operation is possible. The liquid in the micro pores does not "flow out" of the pores under normal operating pressures and remains operative for a substantial length of time.

The remote end of a fiber coated for its full length, or a fiber that is gas permeable and non-porous, may be plugged with a material that permits passage of water. Wettable cross linked polymers such as polyacrylic esters, cellulose acetate, polyacrylamide and other polymers having polar and/or ionizable functional groups that render them hydrophilic may be used to form the plug. Uncoated microporous membranes such as polyproylene and polyethylene may be heat sealed at the remote end. A separate plug is not then necessary.

The gas supply which is connected to the open end of the fibers is pressure regulated and replenishes the gas passing through the first section of the walls of the fibers into the liquid.

Liquid to be treated contacts the exterior surfaces of the fibers for the gas exchange. As shown in one embodiment, the liquid is propelled through a housing which has an inlet and an outlet and surrounds the fibers along the length of the fibers to localize fluid flow around the fibers and to separate liquid passing over the fibers from ambient liquid.

The combination of gas permeable and water permeable or wetted wall portions of the fibers permits efficient gas transfer without bubble formation, and approaches 100% gas transfer efficiency with continuous operation possible because condensate will be discharged through the wetted-water transfer wall section.

BRIEF DESCRIPTION OF THE DRAWINGS

FIG. 1 is a side view of the gas transfer device of a first form of the present invention shown in a horizontal position;

FIG. 2 is a schematic cross-sectional view of a single tubular fiber; and

FIG. 3 is a schematic view of vertically oriented fibers in a second form of the invention.

DETAILED DESCRIPTION OF THE PREFERRED EMBODIMENTS

A gas transfer device indicated generally at 10 includes a plurality of elongated tubular fibers 12, which are mounted in a flow conduit or housing 16, through which a surrounding liquid to be treated is moved or caused to flow with a pump 18. The pump includes an impeller 18A on the interior of the conduit or housing 16. This device can efficiently transfer gases such as oxygen, carbon dioxide and sulfur dioxide into a liquid such as water for a variety of applications. Treatment of waste water is one such application.

The tubular fibers 12 have continuous interior passageways or openings. The fibers are elongated and have open ends held in a gas manifold 14, which is connected to a pressurized gas supply 15. A pressure regulator 17 is used in the system to obtain a desired regulated pressure for the gas supplied to the interiors of the fibers.

As shown schematically in FIG. 2, the hollow fibers 12 have microporous membrane walls 20 manufactured by shaping an ordinary spinnable high polymer material such as polypropylene, polyethylene, polytetrafluoroethylene and other similar microporous materials made in known processes. The microporous membrane walls 20 preferably have an average pore size between 0.02 and 0.2 microns in diameter and a wall thickness in the range of 25 microns. The fiber wall porosity is between 20 and 40%. Gas under regulated pressure on the interior of the fibers passes through the pores and diffuses into the surrounding liquid. Additionally, the fibers 12 have a relatively small outside diameter, preferably between 100 and 400 microns.

A plug 22 seals one end of the interior passageway of each fiber 12 and the other end 24 is open to receive gas from the manifold 14, which has the regulated gas supply connected to it. This open end 24 is connected to the manifold 14 by anchoring the open end in a quantity of potting compound on a support panel which has openings aligned with the openings on the fibers so gas from the manifold can enter the fiber openings. The connection of the open ends of the fibers to the manifold can also be accomplished using other known techniques.

The fibers can be attached to a connector of any desired form, as long as the ends remain open at the manifold so gas can be introduced into the interior of the fibers.

The plug 22 prevents bubbles from escaping at an otherwise open remote end of the tubular fibers 12. The plugged ends are not attached directly to any structure so substantially the entire length of each fiber 12 is allowed to move with local flow patterns downstream to induce surface shear and improve gas transfer. The plug 22 may be of a material that will permit water passage at the differential pressures used for gas transfer, such as cross linked polyacrylamide or a wettable polymer that is not biodegradable and which will bond or is capable of being anchored to the fiber material so it does not blow out during use.

A thin, smooth, chemically resistant, non-porous, gas permeable polymer coating 26, such as gas permeable plasma polymerized disiloxane, approximately 1 micron in thickness, is applied to the exterior surface of at least a major portion of each fiber 12. If an end plug made of a water transfer material is not used, an outer or remote end portion 28 occupying 0.5–5% of the fiber length remains uncoated so there are micro pores providing passageways through the wall.

The coated fiber may be manufactured in any commercially acceptable manner, such as that disclosed in U.S. Pat. No. 4,824,444. This coating 26 performs a number of functions which promote efficient gas transfer. The smoothness of coating 26 inhibits the accumulation of debris and microorganisms which tend to clog the surface through which the gas diffuses. Gas under pressure on the interior of the fibers, which can pass through the pores of the fiber walls, also can permeate the non-porous coating 26 because of its thinness and composition. In addition, since coating 26 is non-porous, bubble formation is precluded. If no coating were applied, gas exiting the membrane pores would tend to form bubbles on the fiber surface at a pressure differential of 1 to 2 psi between interior and the exterior of the fibers. The non-porous coating 26 allows operation at higher gas pressures, which results in higher gas transfer rates, and prevents the loss of gas in bubbles. Efficient gas transfer results when using the coated fibers. The regulated gas pressures supplied to the interior of coated fibers is preferably between 20 psi and 60 psi. Most desirably the gas pressure is above 40 psi. If the fibers are uncoated the pressure differential has to be below 2 psi to avoid bubbles.

A fiber portion 28 is left uncoated and is wetted to allow water vapor that has back diffused into the interior passageway of the fiber and condensed as discussed above, to exit the fiber. Since the pressurized gas forces any condensed vapor to the end of the fibers adjacent plug 22, the uncoated, wetted portion 28 need only be an end portion adjacent plug or seal 22 so that the area of fiber membrane 20 available for gaseous diffusion is maximized. In the extreme case, the plug itself may be made water permeable to allow the escape of condensate.

To prevent gas from exiting through the fiber membrane wall at uncoated end portion 28 and forming bubbles, the end portion 28 is initially wetted with a wetting agent. A water miscible solvent such as alcohol may be used or a surfactant that enters the pores of the membrane and wets the fiber membrane material also works. The solvent or surfactant initially wets the fiber membrane by capillary action, blocks exit of gas from the interior of the fiber at normal operating pressures and also provides an avenue through which the condensed water vapor exits, also by capillary action.

Studies have shown that using wetted microporous polypropylene fibers pressures in excess of 150 psi are needed to blow the liquid out of the micro pores, which would then permit gas to pass out of the fiber through the wall of the previously wetted section. The wetting agent is used initially to lower the surface tension of the water sufficiently to permit the liquid phase to fill the micro pores. Normally water has a high enough surface tension that it cannot enter the micro pores. However, once the micro pores are wetted, water may freely pass through the micro pores and the condensate on the interior of the fiber adjacent to the wetted pores can move into the pores and subsequently out of the fiber into the external liquid. The transport of the condensate from the interior to the exterior of the fiber is encouraged by the higher internal operating pressure. The condensate can thus continuously escape to the exterior.

The bubble point pressure of wetted microporous polypropylene fibers has been found to be in excess of 150 psi, that is, the internal gas pressure has to be over 150 psi before the gas will force the wetting agent and/or water out of the membrane pores and form bubbles of escaping gas. Thus, the maximum pressure for satisfactory operation using a wetted, uncoated fiber portion is about 150 psi. Gas supply 15 continuously supplies gas to the manifold 14 and thus to fibers 12 at a controllable regulated pressure selected to insure that the partial pressure of the gas is kept high along the length of the fibers for transfer to the liquid, but below the bubble point. As the difference in pressure of the gas inside the fibers 12 and the liquid outside the fibers increases, the driving force or gas transfer rate across the fiber membrane increases.

The housing 16 is a tube that has an inlet 30 and an outlet 32 and surrounds the fibers 12 along their length to localize fluid flow around the fibers and separate liquid passing over the fibers from ambient liquid. The housing 16 is submerged in a pool of liquid to be treated and part of the liquid is bypassed through the housing and over the fibers 12. This housing 16 is preferably of a shape that encourages the fibers to spread out across the cross section, such as occurs in a rectangular shaped tube. Deflectors 21 can be attached to an interior of the wall to encourage turbulence of the liquid flowing past the fibers, which also induces mass transfer of the gas. The housing can be positioned so the fibers extend in either a vertical or a horizontal direction, or at any angle in between. The flow can be induced to flow transversely across the lengths of the fibers, as well as along the fibers as shown.

Liquid is propelled through the housing 16 by means such as pump 18. The flow rate should be at least high enough to keep the fibers 12 dispersed in the liquid untangled and free-floating, and is preferably greater than 1 meter per second for horizontal flow. Flows less than 1 meter per second, for example, 0.01 to 0.4 meter per second, can be used when the housing is oriented for vertical flow and high efficiencies can be obtained.

In operation, as liquid enters inlet 30 of the housing 16 and is pumped by pump 18 and impeller 18A through the interior of the housing 16 and past the exterior of fibers 12 it can be varied to increase or decrease the transfer rate of the gas. Gas is continuously supplied to the interior of each fiber 12 at the open end 24 by gas supply 15. The number of fibers 12 can vary depending on the desired gas transfer rate. Gas which enters the fibers 12 passes through the dry pores of membrane 20, permeates the non-porous coating 26, and diffuses into the liquid being propelled past the exterior of the fibers without forming bubbles. Essentially 100% efficiency is obtained and a low power input is required, thus minimizing the cost of transferring a gas into a liquid.

In FIG. 3, a modified form of the invention showing a plurality of fibers mounted onto manifolds that extend transversely across a tank or chamber, and wherein the fibers extend generally vertically is illustrated. In this instance, a confinement tank indicated generally at 40 has flow straightener baffles 41 at its ends and is filled with a liquid to be treated. A plurality of manifolds indicated at 42 are supported at the bottom of the tank, and each of the manifolds has a plurality of individual fibers 43 therein which have closed remote ends as illustrated above. A supply of gas is provided to each of the manifolds 42, so that gas is present in the interior of the fibers 43. The fibers tend to float and extend upright, and when an impeller such as that shown at 44 is started to move liquid transversely across the fibers, they will tend to bend in the direction of liquid flow. The fibers 43 also have wetted end portions to permit condensate to escape, and in this form of the invention, high transfer rates can be achieved at relatively low liquid flow rates.

The microporous fibers can be left uncoated, so long as a section of the fiber is wetted for permitting transfer of condensate from the interior to the exterior so that the gas transfer device can operate continuously. The unwetted portions of the fibers would permit gas to escape into the liquid. The operating pressures would have to be lower than with a coated fiber, to avoid bubbles, but the wetted section will permit capillary action to carry condensation that forms on the interior of the fibers out through the membrane wall.

The efficiency of gas transfer using the principles of the present invention has been demonstrated in laboratory tests using a single coated fiber that measured 76 cm in length and having an external diameter of 0.0425 cm which was mounted in a glass tube, and then pressurized with oxygen. Deoxygenated water was recycled from a reservoir through the glass tube and over the outside of the fiber. The fiber was plugged at its remote as shown herein, and oxygen transfer was measured by measuring the increase in the oxygen concentration in the reservoir with time.

Table A below shows the results. The key to the designation at the top of the columns follows the table.

TABLE A

| 1 | Q,L/min | Vel,cm/s | $O_2$ press | $k_L$,cm/sec | Sh | Re |
|---|---|---|---|---|---|---|
| 2 | 4.18 | 245.03 | 20 | 0.03271 | 951.99 | 16577.2 |
| 3 | 4.18 | 245.03 | 30 | 0.0343 | 998.05 | 16577.2 |
| 4 | 4.18 | 245.03 | 40 | 0.03538 | 1029.5 | 16577.2 |
| 5 | 2.98 | 174.69 | 20 | 0.02687 | 782 | 12070.7 |
| 6 | 2.98 | 174.69 | 30 | 0.032 | 931.31 | 12070.7 |
| 7 | 2.98 | 174.69 | 40 | 0.03505 | 1020.1 | 12070.7 |
| 8 | 2.1 | 123.1 | 20 | 0.02012 | 585.44 | 8506.22 |
| 9 | 2.1 | 123.1 | 30 | 0.02653 | 772.15 | 8686.35 |
| 10 | 2.1 | 123.1 | 40 | 0.02987 | 869.22 | 8869.15 |

Q = Flowrate in liters per minute.
Vel = Velocity in centimeters per second.
$O_2$ = oxygen pressure pounds per square inch.
$k_L$ = Overall mass transfer coefficient.
Sh = Sherwood number
Re = Reynolds number The oxygen pressure is the pressure on the interior of the fiber. $k_L$ is a direct measure of the rate of oxygen transfer to the liquid and can be used for comparisons and design. It can be seen that the oxygen pressure at low flow rates affects the transfer coefficient, but at the higher flow rates pressure has a lessened effect.

The dependence of the oxygen transfer coefficient on the process parameters can be expressed by correlations in terms of the nondimensional Sherwood number (Sh) and Reynolds number (Re) as shown in the above table.

The results obtained can be used to design a multi-fiber arrangement very easily, to illustrate the effects of the transfer at commercial sized installations.

It has been observed that when high gas pressures are used (greater than 40 psi) with the fibers constructed as disclosed above, high gas transfer rates, greater than 10 pounds of oxygen per horsepower-hour, at low flow rates can be obtained. Since relative costs of operation (system operation efficiency) can be compared by comparing the transfer rates expressed in lbs. of oxygen transferred per horsepower hour with different operating conditions, reducing the power consumed by pump 18 is important. Thus low flow rates are desired if the time to transfer a selected concentration of the gas to the liquid is not seriously increased. Since gas transfer to a liquid at pressures above 40 psi is fairly insensitive to flow rate, as long as minimum flow sufficient to keep the fibers suspended is provided, high pressures make the overall system efficiency high. Transfer of oxygen, sulfur dioxide, and carbon dioxide into various liquid is achieved efficiently.

The fiber walls may be made of homogeneous gas permeable polymers, such as polydimethylsiloxane, or a polydimethylsiloxane/polycarbonate copolymer. The first wall portion does not have to be coated, but a second portion has to be conditioned, or wetted to permit water passage with no gas bubbles under operating pressure differentials. End plugs of water permeable materials can be used, or conditioned homogeneous material that is wettable also can be used.

Microporous fibers are sold under the trademark CELGARD by Hoechst Celanese of Charlotte, N.C., U.S.A. Microporous fibers and homogeneous gas permeable membranes are available from Mitsubishi Rayon Co., Ltd. of Tokyo, Japan. Various other available fibers and membranes are listed in U.S. Pat. No. 4,824,444.

Although the present invention has been described with reference to preferred embodiments, workers skilled in the art will recognize that changes may be made in form and detail without departing from the spirit and scope of the invention.

What is claimed is:

1. A process for efficiently transferring a gas directly into a liquid on a continuous basis without the formation of bubbles through a plurality of elongated hollow fibers having gas permeable walls, comprising:

closing one end of each tubular fiber;

providing each tubular fiber with a water transfer wall portion adjacent the one end for transferring internal condensate through the wall portion under an applied pressure gradient; and supplying gas to the interior of each of the tubular fibers at open ends opposite the one end thereof so that the gas passes through the fiber walls, along the portions of the fiber, other than the water transfer portion, and diffuses into a liquid in which the fibers are placed.

2. The process of claim 1 including the step of initially providing the water transfer portion by conditioning a portion of each tubular fiber to permit water vapor that has entered the fiber and condensed to exit the fiber while preventing the release of gas by bubble formation.

3. The process of claim 1 wherein the step of supplying gas to each tubular fiber comprises regulating the gas to be at a pressure below the pressure level where bubbles form at exterior surfaces of either the wetted or non wetted portions of the fibers.

4. The process of claim 1 wherein the step of supplying gas comprises supplying pure oxygen at a pressure so that a high concentration gradient encourages rapid diffusion through walls of the fibers.

5. The process of claim 1 wherein the step of supplying gas comprises supplying $CO_2$.

6. The process of claim 1 wherein the step of supplying gas comprises supplying $SO_2$.

7. The process of claim 1 including the step of selecting the material of the fibers to be micro porous and wetting the water transfer wall portion of the fibers.

8. The process of claim 7 wherein the step of supplying the gas to the fibers comprises maintaining the differential pressure of gas at the interiors of the fibers and liquid at the exteriors of the fibers below 2 psi.

9. The process of claim 7 including the step of coating the outside surface of the non wetted portions of the hollow fibers with a non porous gas permeable layer.

10. The process of claim 9 and the step of selecting the material of the fibers to be polypropylene, the outside diameter of the fibers to be between 100 and 400 microns, the membrane wall thickness of the fibers to be in the range of 10 to 25 microns, and the average diameter of the pores in the fiber membrane walls to be between 0.02 and 0.2 microns.

11. The process of claim 9 wherein the step of coating the non wetted portion of the fibers comprises applying an external coat of plasma polymerized disiloxane approximately 1 micron in thickness.

12. The process of claim 9 wherein the step of supplying gas to the fibers comprises maintaining the pressure of the gas such that the differential pressure of the gas at interiors of the fibers and liquid at exteriors of the fibers is between 20 and 60 psi.

13. An apparatus which transfers gas into a liquid through a plurality of elongated tubular fibers having membrane walls with interior surfaces and exterior surfaces comprising:

a plurality of fibers, each having an open end and a sealed end and being adapted to extend into a liquid, each fiber having a first wall portion which is gas permeable and a second wall portion and/or a plug which permits transfer of water from the interior surface to the exterior surface; and a regulated gas supply connected to the open end of the fibers to provide gas to the interior of the fibers at a pressure which causes the gas to pass through the wall of the first portion of the fibers without bubbling at the exterior surfaces of the first or second wall portion.

14. The apparatus of claim 13 wherein the fibers are made of polypropylene, and have micro pores having a diameter of between 0.02 and 0.2 microns, the first portions of the fibers having their exterior surfaces coated with a non porous gas permeable layer.

15. The apparatus of claim 13 wherein the first wall portions of the fibers are micro porous and have a coating of plasma polymerized disiloxane on the exterior which is approximately 1 micron in thickness.

16. The apparatus of claim 13 and a housing in ambient liquid to which gas is to be transferred, said housing having an inlet and an outlet and surrounding the fibers along the length of the fibers to localize fluid flow around the fibers and to separate liquid passing 17. The apparatus of claim 13 wherein the fibers are microporous and first portions of the fibers are coated with a non porous gas permeable exterior layer and wherein the pressure of gas supplied to the fibers is regulated such that the differential pressure of the gas at the interior of the fibers and a liquid at the exterior of the fibers is between 20 and 60 psi.

18. The apparatus of claim 13 and a manifold for anchoring the open ends of the fibers with the sealed ends being free to move, the manifold being below the surface of a liquid such that the fibers extend generally vertically in the liquid.

19. The apparatus of claim 13 wherein the first wall portion of the fiber is a homogeneous, hydrophobic, non-porous gas permeable polymer, and the second portion comprising a hydrophilic and water permeable material.

20. The apparatus of claim 13 wherein the first wall portion of the fiber is a homogeneous, hydrophobic, non-porous gas permeable polymer, and the second portion is a water permeable plug.

21. The apparatus of claim 13 the water transfer portion having pores therein, and a filling of a wetting agent in such pores when the apparatus is first placed in service.

22. The apparatus of claim 21 wherein the wetting agent is a water miscible solvent or surfactant.

23. A tubular membrane for transferring gas to a liquid having an open end adapted for connection to a regulated gas supply and a closed end remote from the open end, the tubular membrane having a wall that is gas permeable along a first portion of a length of the membrane between the open end and closed end, a second portion of the wall adjacent the closed end having pores filled with a liquid to prevent passage of gas through the second portion of the wall below a bubble point pressure on the interior, but causing capillary action to transfer liquid through the second portion from an interior of the tubular membrane to an exterior under operating gas pressures within the tubular membrane.

24. The tubular membrane of claim 23 wherein both portions of the wall are micro porous and the first portion is coated on an exterior surface with a non-porous, gas permeable layer.

* * * * *

UNITED STATES PATENT AND TRADEMARK OFFICE

CERTIFICATE OF CORRECTION

PATENT NO. : 5,034,164

DATED : July 23, 1991

INVENTOR(S) : Michael J. Semmens

It is certified that error appears in the above-identified patent and that said Letters Patent is hereby corrected as shown below:

Col. 10, line 14, after "passing", insert --over the fibers from ambient, and means for propelling the liquid through the housing."

Signed and Sealed this

First Day of December, 1992

*Attest:*

DOUGLAS B. COMER

*Attesting Officer*

*Acting Commissioner of Patents and Trademarks*